US005729098A

United States Patent [19]

Konopka et al.

[11] Patent Number: 5,729,098

[45] Date of Patent: Mar. 17, 1998

[54] POWER SUPPLY AND ELECTRONIC BALLAST WITH A NOVEL BOOST CONVERTER CONTROL CIRCUIT

[75] Inventors: John G. Konopka, Barrington; Dennis L. Stephens, Niles, both of Ill.

[73] Assignee: Motorola, Inc., Schaumburg, Ill.

[21] Appl. No.: 659,099

[22] Filed: Jun. 4, 1996

[51] Int. Cl.[6] ..... H05B 37/00

[52] U.S. Cl. ..... 315/307; 315/224; 315/DIG. 5

[58] Field of Search ..... 315/219, 209 R, 315/224, 226, 291, 307, 308, DIG. 5, 244

[56] References Cited

U.S. PATENT DOCUMENTS

| | | | |
|---|---|---|---|
| 4,724,360 | 2/1988 | Luursema | 315/244 |
| 5,115,347 | 5/1992 | Nilssen | 315/247 |
| 5,334,915 | 8/1994 | Ohsaki et al. | 315/307 |
| 5,363,020 | 11/1994 | Chen et al. | 315/209 R |
| 5,367,228 | 11/1994 | Kachmarik et al. | 315/307 |
| 5,406,177 | 4/1995 | Nerone | 315/307 |
| 5,434,477 | 7/1995 | Crouse et al. | 315/209 R |
| 5,434,481 | 7/1995 | Nilssen | 315/247 |
| 5,461,287 | 10/1995 | Russell et al. | 315/209 R |
| 5,469,027 | 11/1995 | Uchihashi et al. | 315/224 |
| 5,471,118 | 11/1995 | Nilssen | 315/247 |
| 5,485,059 | 1/1996 | Yamashita et al. | 315/307 |

*Primary Examiner*—Robert Pascal
*Assistant Examiner*—David Vu
*Attorney, Agent, or Firm*—Gary J. Cunningham; Kenneth D. Labudda

[57] ABSTRACT

An electronic power supply (10) includes a boost converter (100) and an inverter (600). The inverter (600) includes a first inverter node (602) having a periodically varying voltage, and a second inverter node (604) having a voltage with a peak value that is proportional to the dc output voltage of the boost converter (100). The boost converter (100) includes a control circuit (200) for driving a boost FET (110). Control circuit (200) includes a shunt circuit (300) having a shunt switch (308) for periodically turning off the boost FET (110), a drive source network (400) that is coupled to the first inverter node (602), and a load regulation network (500) that is coupled to the second inverter node (604). In a preferred embodiment, the power supply (10) includes a rectifier circuit (40) and a push-pull inverter (600), and is adapted to serve as an electronic ballast for powering at least one fluorescent lamp (702).

19 Claims, 4 Drawing Sheets

POWER SUPPLY AND ELECTRONIC BALLAST WITH A NOVEL BOOST CONVERTER CONTROL CIRCUIT

FIELD OF THE INVENTION

The present invention relates to the general subject of power supplies and, in particular, to a power supply and electronic ballast that includes a novel boost converter control circuit.

BACKGROUND OF THE INVENTION

Several types of electronic power supply and ballast circuits employ a boost converter for the primary purpose of providing power factor correction. Typically, the boost converter is controlled by a sophisticated control circuit, the central component of which is a pulse-width modulator (PWM) or power factor correction (PFC) integrated circuit (IC), one example of which is the MC33262 IC manufactured by Motorola, Inc.

Key internal elements of PWM and PFC ICs include an oscillator which provides a square-wave voltage for driving a boost converter field-effect transistor (FET), a cycle-by-cycle current-limiting function for turning off the FET once the boost FET current has risen to a predetermined value, an overvoltage comparator for turning off the FET when the boost converter dc output voltage attempts to exceed a predetermined limit, and a totem-pole transistor pair for terminating the drive voltage quickly and in such a fashion so as to rapidly discharge the gate-to-source capacitance of the boost FET, thereby turning the FET off quickly and minimizing turn-off losses in the FET. More specifically, a properly designed boost converter that uses a conventional PWM/PFC boost control circuit provides the following key functional features:

(1) A high degree of power factor correction, that is characterized by a power factor in excess of 0.99 and a total harmonic distortion (in the input current) of less than 10%.

(2) Cycle-by-cycle current limiting, also referred to as "current-mode control", which allows for adjustment of the FET drive duty cycle as a function of the boost converter input voltage, thereby providing for a high degree of power factor correction over a large range of input voltage and load conditions.

(3) Load regulation, which implies maintaining a constant boost converter dc output voltage over a wide range of loads.

(4) Overvoltage protection, by which the boost converter is shut down if the dc output voltage attempts, due to sudden loss of load or other fault conditions, to exceed a predetermined limit.

(5) Low switching power losses in the boost FET, especially with regard to turn-off, during which time the majority of FET switching losses occur.

Notwithstanding such advantageous features, conventional PWM/PFC boost control circuits are quite complex and costly, especially in terms of required peripheral circuitry. For example, a relatively large value electrolytic capacitor is typically needed in order to provide dc operating voltage for the IC. With this in mind, a number of attempts have been made at devising simpler and more cost-effective boost converter control circuits. However, none of the circuits disclosed thus far have succeeded in combining emulation of the key functional features of conventional PWM/PFC control circuits along with a significant reduction in the number of required electrical components.

U.S. Pat. No. 5,434,481, issued to Nilssen, discloses an electronic ballast circuit in which drive for the boost FET is provided by a feedback signal from a downstream inverter. Nilssen also provides for overvoltage protection, but relies upon a vaguely specified "bistable control element" which potentially requires a significant number of components in its own right. Furthermore, Nilssen provides for neither current-mode control nor load regulation, which are extremely important advantages of conventional approaches as noted above.

U.S. Pat. No. 5,461,287, issued to Russell, discloses an electronic ballast having a discrete boost converter control circuit which includes current-mode control. The circuit disclosed by Russell has two major deficiencies, however. First, the drive signal for the boost FET is supplied by a secondary winding on the boost inductor, which results in greater cost and complexity in the boost inductor. Secondly, means for achieving load regulation and overvoltage protection are neither disclosed nor suggested by Russell.

It is therefore apparent that a power supply having a boost converter control circuit which provides a high degree of power factor correction, current-mode control, load regulation, overvoltage protection, and proper switching of the boost FET, and which involves significantly fewer components, and thus a lower material and manufacturing cost, than existing approaches, would constitute a significant improvement over the prior art.

DETAILED DESCRIPTION OF A PREFERRED EMBODIMENT

Figure 1:
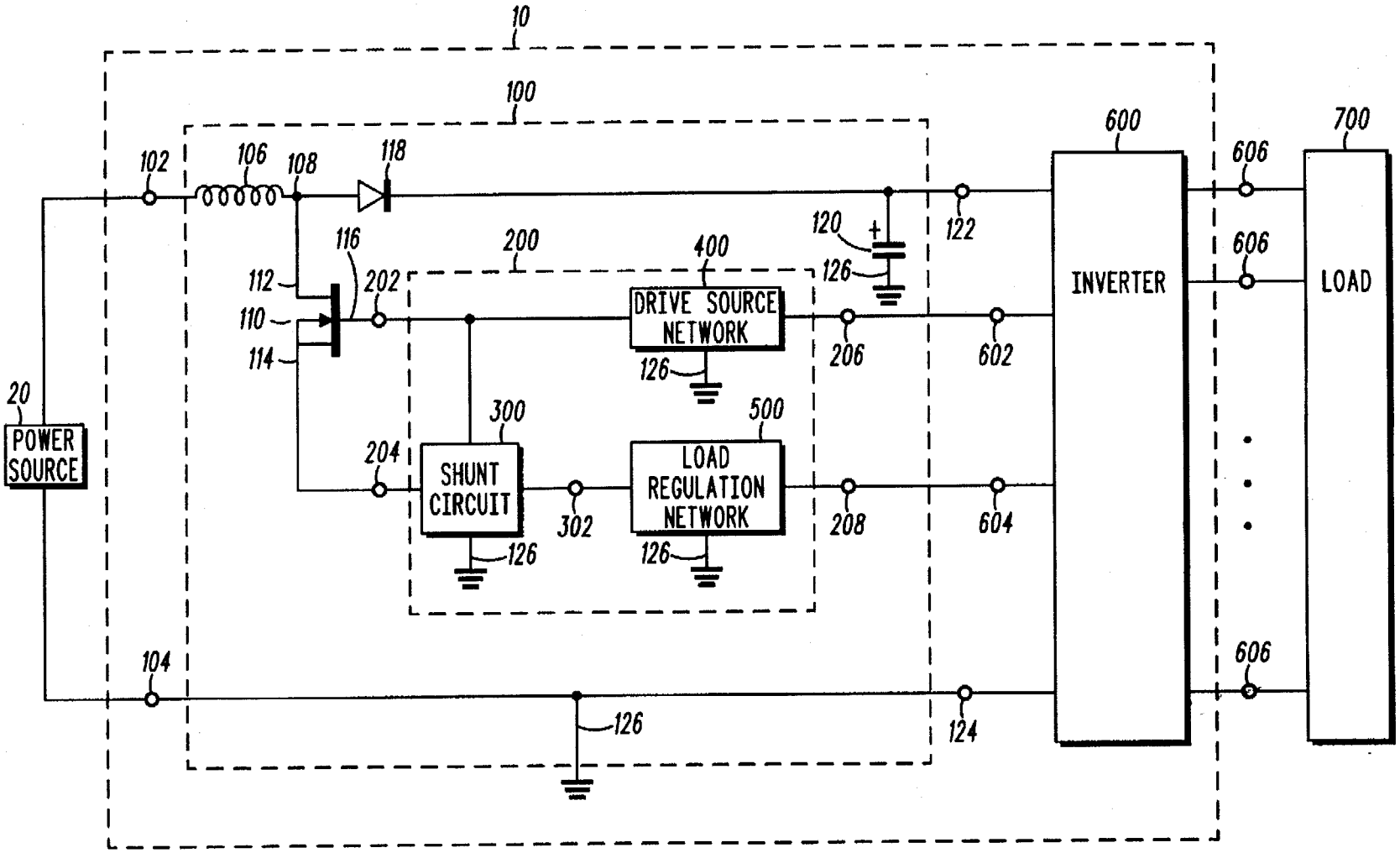
FIG. 1 shows an electronic power supply with an improved boost converter control circuit, in accordance with the present invention.

FIG. 1 describes an electronic power supply circuit 10 that includes a boost converter 100 and an inverter 600. Boost converter 100 includes a pair of input terminals 102, 104 that are adapted to receive a source of electrical power 20, and a pair of output terminals 122, 124, across which boost converter 100 is operable to provide an approximately direct current (dc) output voltage. Electrical power source 20 typically comprises a source of full-wave rectified ac voltage, but may alternatively comprise a source of direct current. Inverter 600, which is coupled across boost converter output terminals 122, 124, includes a first inverter node 602, a second inverter node 604, and a plurality of output connections 606 that are adapted to be coupled to a load 700. First inverter node 602 is characterized by a periodically varying voltage, while second inverter node 604 has a voltage with a peak value that is approximately proportional to the dc output voltage of boost converter 100.

As shown in FIG. 1, boost converter 100 includes a boost inductor 106, a boost field-effect transistor (FET) 110, a boost rectifier 118, a bulk capacitance 120, and a control circuit 200 for controlling the boost FET 110. Boost inductor 106 is coupled between a first node 108 and a first input terminal 102, while boost rectifier 118 is coupled between the first node 108 and a first output terminal 122 of boost converter 100. Boost FET 110 includes a source terminal 114, a gate terminal 116, and a drain terminal 112 that is coupled to the first node 108. Bulk capacitance 120 comprises at least one capacitance that is coupled across the boost converter output terminals 122, 124. Control circuit 200 includes several input/output terminals, including a current sense input 204, a drive output 202 that is coupled to the gate terminal 116 of boost FET 110, a drive source input 206 that is coupled to the first inverter node 602, and a load regulation input 208 that is coupled to the second inverter node 604.

Control circuit 200 comprises a shunt circuit 300, a low-impedance drive source network 400, and a load regulation network 500. Shunt circuit 300, which is operable to periodically switch the boost FET 110 off, is coupled to drive output 202 and current sense input 204, and includes a voltage sense input 302. Drive source network 400 is coupled between drive source input 206 and drive output 202, and is operable to supply to drive output 202 a voltage that periodically assumes a predetermined dc level that is sufficient to turn on boost FET 110. Load regulation network 500 is coupled between the load regulation input 208 and the voltage sense input 302 of shunt circuit 300, and is operable to supply to the voltage sense input 302 a voltage that is substantially proportional to the dc output voltage of boost converter 100.

Power supply 10 uses the inverter 600 as a source for the FET drive and load regulation signals, thereby allowing for a simple boost control circuit 200 which emulates the key functional advantages of PWM/PFC boost control circuits, but requires significantly fewer components than existing approaches.

Figure 2:
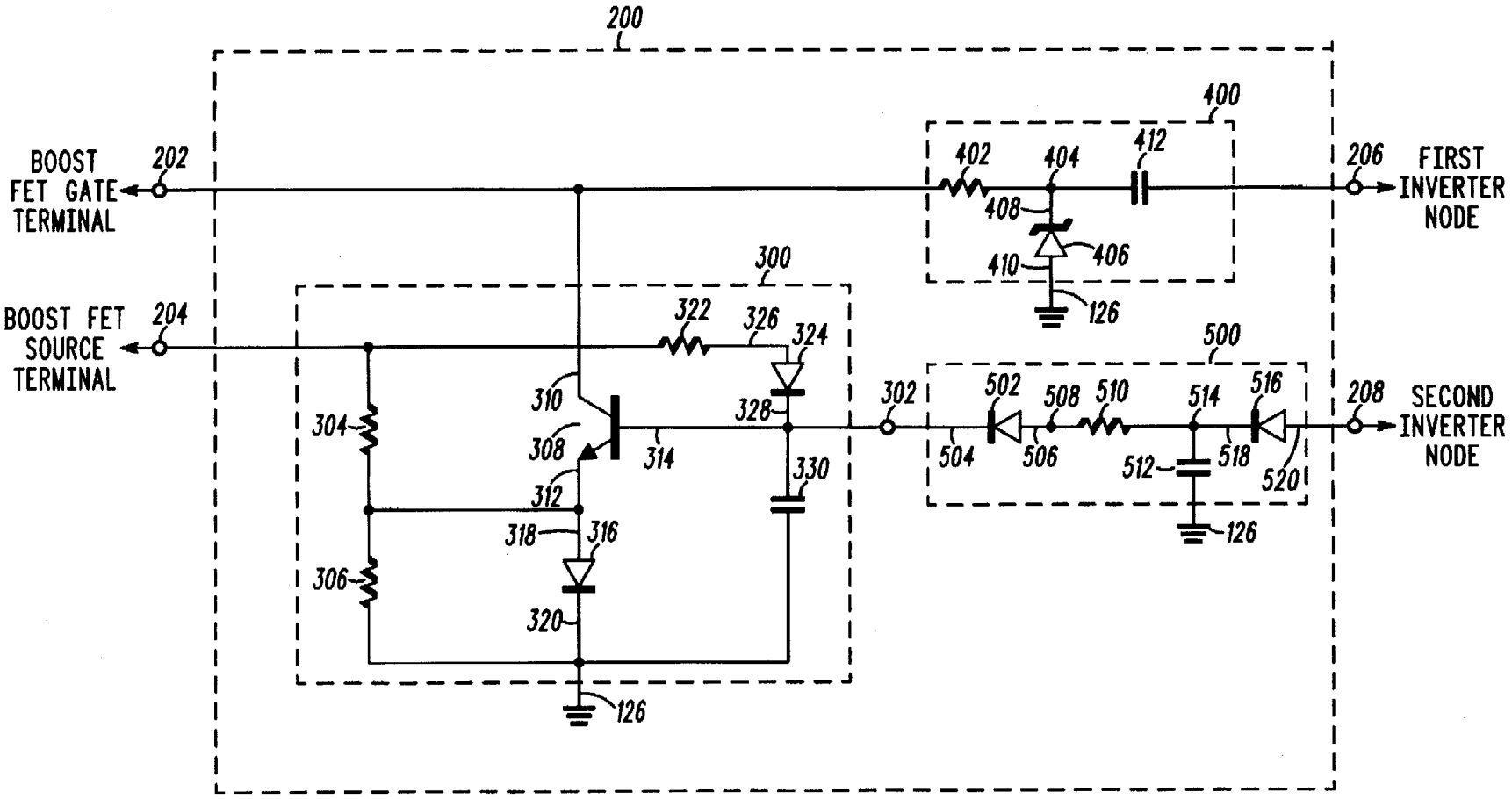
FIG. 2 is a circuit diagram of a boost converter control circuit, in accordance with the present invention.

A preferred embodiment of control circuit 200 is described in FIG. 2. Shunt circuit 300 comprises a shunt switch 308, a current sense resistor 304, a base resistor 322, a base rectifier 324, a base capacitor 330, an emitter biasing resistor 306, and an emitter clamping diode 316. Shunt switch 308, which is preferably a bipolar junction transistor (BJT) or an equivalent type of device, has an emitter lead 312, a collector lead 310 that is coupled to the drive output 202, and a base lead 314 that is coupled to the voltage sense input 302. Current sense resistor 304 is coupled between the current sense input 204 and the emitter lead 312. Base resistor 322 is coupled between the current sense input 204 and an anode 326 of base rectifier 324, while a cathode 328 of base rectifier 324 is coupled to the base lead 314. Base rectifier 324 serves to prevent flow of current from the voltage sense input 302 to the current sense input 204. Base capacitor 330 is coupled between the base lead 314 and the circuit ground node 126. Emitter biasing resistor 306 is coupled between emitter lead 312 and circuit ground node 126, while emitter clamping diode 316 has an anode terminal 318 that is coupled to the emitter lead 312, and a cathode terminal 320 that is coupled to circuit ground node 126.

Referring again to FIG. 2, drive source network 400 includes a coupling capacitor 412 that is coupled between the drive source input 206 and a second node 404, a first current limiting resistor 402 that is coupled between the second node 404 and the drive output 202, and a zener diode 406 having a cathode 408 that is coupled to the second node 404, and an anode 410 that is coupled to circuit ground node 126.

Load regulation network 500 comprises a first rectifier 516, a dc filtering capacitor 512, a second current limiting resistor 510, and a second rectifier 502. First rectifier 516 has an anode 520 that is coupled to the load regulation input 208, and a cathode 518 that is coupled to a third node 514. The dc filtering capacitor 512 is coupled between the third node 514 and circuit ground node 126. The second current limiting resistor 510 is coupled between the third node 514 and a fourth node 508. Second rectifier 502 has an anode 506 that is coupled to the fourth node 508, and a cathode 504 that is coupled to the voltage sense input 302 of shunt circuit 300.

In one embodiment, inverter 600 includes two power switches, and is operable to complementarily commutate the two power switches, such that when one switch is on, the other is off, and vice versa.

Figure 3:
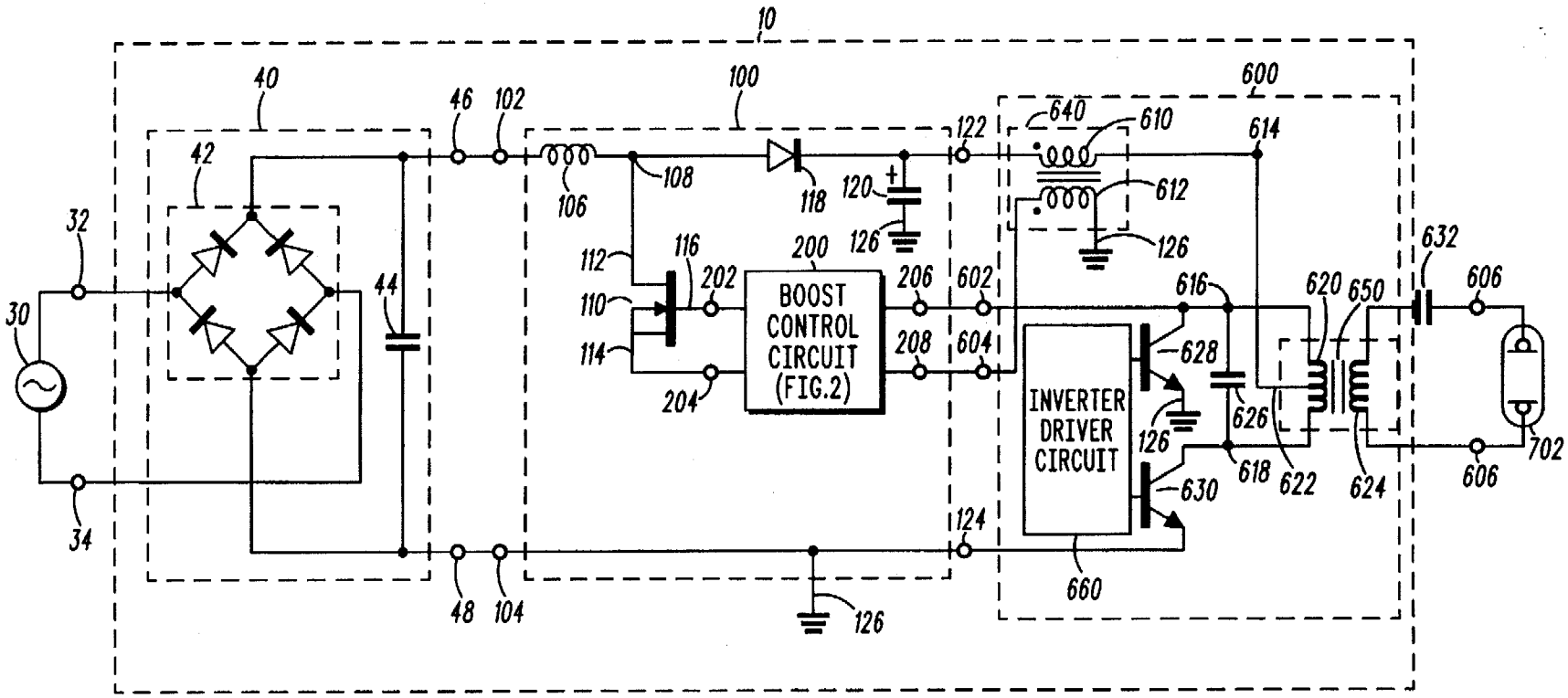
FIG. 3 shows an electronic ballast for fluorescent lamps, in accordance with the present invention.

Turning now to FIG. 3, in a preferred embodiment power supply 10 includes a rectifier circuit 40, a push-pull type inverter 600, and is adapted to function as an electronic ballast for driving at least one fluorescent lamp 702. Rectifier circuit 40 has a pair of input wires 32, 34 that are adapted to receive a source of alternating current 30, and a pair of output wires 46, 48 that are coupled to the boost converter input terminals 102, 104. In one embodiment, rectifier circuit 40 includes a full-wave diode bridge 42 and a high frequency filter capacitance 44 that is coupled across the rectifier circuit output wires 46, 48.

As shown in FIG. 3, inverter 600 comprises a current feed inductor 640 having a primary winding 610 and a secondary winding 612, and a resonant inductor 650 having a primary winding 620 with a center tap 622. Inverter 600 further includes a resonant capacitor 626, a first power switch 628, and a second power switch 630. A preferred way in which to accommodate a load consisting of at least one fluorescent lamp 702 is to include a secondary winding 624 on the resonant inductor 650, as well as at least one ballasting capacitor 632 for limiting the current supplied to lamp 702.

The current feed inductor primary winding 610 is coupled between the first boost converter output terminal 122 and a fifth node 614, while current feed secondary winding 612 is coupled between circuit ground node 126 and the load regulation input 208 of boost control circuit 200. The primary winding 620 of resonant inductor 650, along with the resonant capacitor 626, is coupled between a sixth node 616 and a seventh node 618, and the center tap 622 is coupled to the fifth node 614. The first power switch 628 is coupled between the sixth node 616 and the circuit ground node 126, while the second power switch 628 is coupled between the seventh node 618 and the circuit ground node 126. The sixth node 616 is coupled to the drive source input 206 of control circuit 200; it should be recognized that the same functionality can be achieved in an alternative embodiment by coupling the seventh node 618, instead of the sixth node 616, to the drive source input 206. Various operational details of push-pull inverter 600, such as the drive and control of the two power switches 628, 630 by way of an inverter driver circuit 660 that uses any of a variety of complementary commutation methods, are widely known among those skilled in the art of power supplies and electronic ballasts.

With reference to FIG. 3, the operation of power supply 10 is explained as follows. During steady-state operation of inverter 600, the voltage present across either power switch 628, 630 resembles a half-wave rectified sinewave. Specifically, when the first power switch 628 is on, the voltage at the sixth node 616 is approximately equal to zero and the voltage at the seventh node 618 resembles the positive half of a sinewave. Similarly, when the second power switch 630 is on, the voltage at the seventh node 618 is approximately equal to zero and the voltage at the sixth node 616 resembles the positive half of a sinewave.

Referring now to FIG. 2, the operation of drive source network 400 can be understood as follows. Capacitor 412 and zener diode 406 function together to produce a voltage ($V_x$) at node 404 that has a peak value equal to the reverse breakdown voltage ($V_z$) of zener diode 406, and that has a duration of approximately one-half that of the voltage ($V_{source}$) that is supplied by the inverter 600 to the drive source input 206. For purposes of providing a proper gate drive voltage for the boost FET 110, $V_z$ is preferably on the order of 15 volts.

In a preferred embodiment having a push-pull type inverter such as that shown in FIG. 3, $V_{source}$ resembles a half-wave rectified sinewave. As $V_{source}$ starts to increase from zero and soon reaches a value equal to $V_z$, zener diode 406 begins to operate in the reverse conduction mode and clamps the voltage at node 404 to $V_z$. $V_x$ remains at this constant value until $V_{source}$ reaches its peak value. Once $V_{source}$ reaches its peak value and then begins to decrease, the current flowing through capacitor 412 reverses direction and begins to flow from node 404 back to drive source input 206, causing zener diode 406 to go from the reverse conduction mode ($V_x=V_z$) to the forward conduction mode ($V_x\approx-0.6$ volts). Zener diode 406 remains in the forward conduction mode, and $V_x$ remains at about −0.6 volts, until about the time at which $V_{source}$ decreases to zero, at which point $V_x$ also goes to zero. $V_x$ remains at zero until $V_{source}$ again goes positive at the start of the next cycle, and the foregoing events are repeated.

Due to the clamping action of zener diode 406 and the fact that the preferred zener breakdown voltage of 15 volts is considerably smaller than the peak value of $V_{source}$, $V_x$ can therefore be approximately described as a square wave with a peak value of 15 volts, a minimum value of −0.6 volts, and a duty cycle of 25%. $V_x$ is coupled to the drive source output 202 via a low value current limiting resistor 402, and thus serves as a suitable low impedance source for driving boost FET 110. Capacitor 412 has the added function of protecting zener diode 406 from high power dissipation by limiting the resulting current which flows into zener diode 406 when it is in the reverse conduction mode. In particular, the magnitude of the current which flows through zener diode 406 by way of capacitor 412 is primarily dependent upon two factors, the capacitance of capacitor 412 and the time rate of change of $V_{source}$.

The operation of shunt circuit 300 in turning off the boost FET 110 is explained as follows. Note that, for the sake of clarity, the effect of the voltage provided at the voltage sense input 302 by load regulation network 500 is neglected in the following description, but is incorporated in the explanation of load regulation network 500 which follows afterwards.

Figure 4:
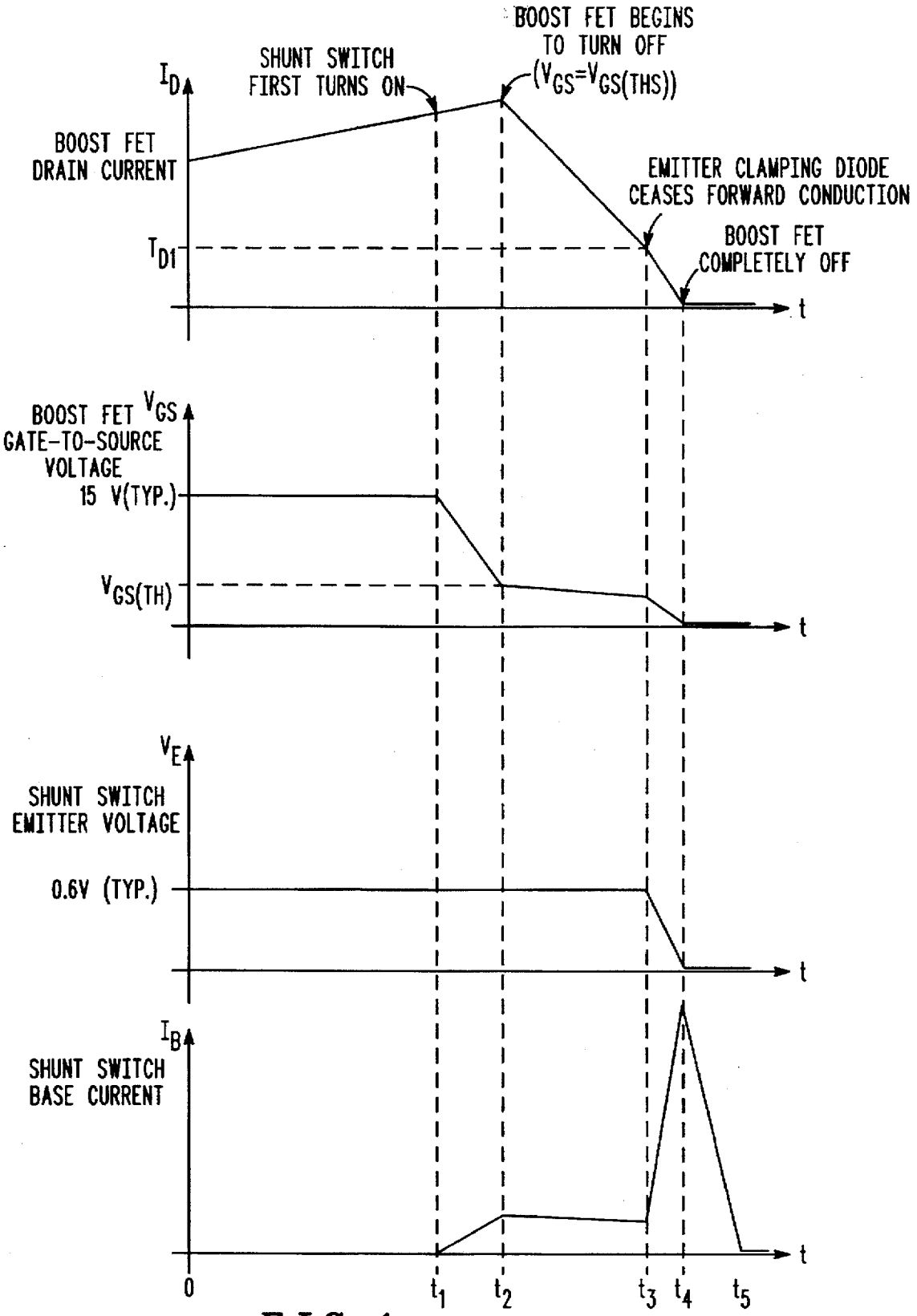
FIG. 4 illustrates several important voltage and current relationships for a boost converter control circuit, in accordance with the present invention.

FIG. 4 shows approximate waveforms of the boost FET drain current ($I_D$) and gate-to-source voltage ($V_{GS}$), as well as the base current ($I_B$) and emitter voltage ($V_E$) of the shunt switch 308, for a portion of a period in which boost FET 110 is on. In the period $0\leqq t<t_1$, the boost FET 110 is on and $I_D$ continues to increase in a linear fashion. During this period, shunt switch 308 is off, and $I_D$ flows into the current sense input 204, through the current sense resistor 304, and is shared between emitter biasing resistor 306 and emitter clamping diode 316. Also, $I_D$ is of sufficient magnitude to produce a voltage across resistor 306 that is large enough to forward bias diode 316. Consequently, $V_E$ is clamped to a value equal to one diode forward voltage drop, or approximately 0.6 volts. Prior to turn-on of shunt switch 308, $V_{GS}$ is at an approximately constant level, preferably 15 volts, as provided by drive source network 400. Therefore, the FET's internal gate-to-source capacitance, $C_{GS}$, is charged up to about 15 volts prior to turn-on of shunt switch 308. Base capacitor 330 is charged up by way of base resistor 322 and base rectifier 324 until finally, at $t=t_1$, the voltage across capacitor 330 reaches a value of approximately 1.2 volts, which equates to a base-to-emitter voltage, $V_{BE}$, of approximately 0.6 volts, which is sufficient to turn shunt switch 308 on.

For $t_1\leqq t<t_2$, shunt switch 308 is on and "pulls down" on the gate terminal 116. Shunt switch 308 shunts drive current provided by drive source network 400 and discharges $C_{GS}$, thereby causing $V_{GS}$ to decrease. However, the boost FET 110 does not actually begin to turn off until, at $t=t_2$, $V_{GS}$ falls to the gate-to-source threshold voltage, denoted by $V_{GS(TH)}$. For $t_2\leqq t<t_3$, as $V_{GS}$ falls below $V_{GS(TH)}$, $I_D$ begins to rapidly decrease. The voltage across capacitor 330 also begins to decay from its maximum value of about 1.2 volts. At $t=t_3$, $I_D$ has decreased to a value $I_{D1}$, which is defined as the minimum drain current needed in order to keep diode 316 in a state of forward conduction.

For $t_3\leqq t<t_4$, as $I_D$ falls below $I_{D1}$, diode 316 ceases to conduct. Consequently, $I_D$, which was previously shared between resistor 306 and diode 316, now flows entirely through resistor 306. The important result is that $V_E$, which is now directly proportional to $I_D$, begins to decrease along with $I_D$. Correspondingly, $I_B$ begins to increase dramatically and shunt switch 308 begins to conduct a much larger collector current than before. The end result is that $C_{GS}$ is discharged at a much faster rate than before, and boost FET 110 is rapidly turned off. With the boost FET 110 completely off, shunt switch 308 remains on and actively prevents subsequent turn on of the boost FET until $t=t_5$, at which point the voltage across capacitor 330 has decayed to below the 0.6 volts necessary for keeping shunt switch 308 on. For $t\leqq t_5$, boost FET 110 will remain off until such time as the drive source network 400 again begins to provide a drive signal at the drive source output 202. In this way, control circuit 200 provides for current-mode control and turn off of the boost FET 110 without producing excessive switching losses in boost FET 110.

Turning now to FIG. 3, during steady-state operation of inverter 600, the voltage across the current feed primary 610 (from the first boost converter output terminal 122 to the fifth node 614) resembles a full-wave rectified sinewave with a negative dc offset and has a peak value that is approximately proportional to the boost converter dc output voltage, $V_{boost}$. Correspondingly, the voltage across current feed secondary 612 will also have a peak value that is approximately proportional to $V_{boost}$. In several applications, the voltage across primary winding 610 is on the order of several hundred volts. It is therefore preferred that the secondary winding 612 possess a small number of turns relative to the number of turns on primary winding 610, so that the voltage across secondary 612 will be a highly scaled down version of the relatively large voltage that is present across primary 610.

The voltage across secondary 612 is fed to the input 208 of load regulation network 500. Rectifier 516 and capacitor 512 function as a peak detector, so the voltage at node 514 is an approximately dc voltage having a value that is, neglecting the forward voltage drop across diode 516, proportional to $V_{boost}$. Resistor 510 limits the current transferred from capacitor 512 to the voltage sense input 302 of shunt circuit 300, while rectifier 502 prevents a backward flow of current from the shunt circuit 300 into the load regulation network 500.

Load regulation network 500 works in conjunction with shunt circuit 300 to provide for a substantially constant, or regulated, boost converter output voltage, $V_{boost}$, in the following manner. In response to a reduction in the power drawn by inverter 600, such as that which occurs when lamp 702 is removed or replaced with a lower wattage lamp, $V_{boost}$ will naturally begin to increase. However, the voltage at node 514 will increase in a corresponding manner, and the load regulation network 500 will increase the voltage present at the voltage sense input 302 of shunt circuit 300. This increases the voltage across base capacitor 330, and results in the boost FET 110 being turned off sooner that it would otherwise have been. Equivalently stated, the boost converter duty cycle, which is defined as the ratio of boost FET on-time to boost FET off-time, will be reduced, the end result being that $V_{boost}$ will eventually return to its normal, regulated value. In the opposite case, in which the power drawn by the inverter is increased, $V_{boost}$ will initially tend to decrease. This decrease in $V_{boost}$ is detected by load regulation network 500, which then reduces the voltage applied to voltage sense input 302. A reduction in the voltage applied to the voltage sense input 302 has the effect of delaying turn off of boost FET 110 (i.e., increasing the duty cycle), thereby causing $V_{boost}$ to increase and eventually return to its normal value. In this way, the boost converter control circuit 200 maintains a regulated boost converter output voltage.

A prototype electronic ballast, configured substantially as shown in FIG. 3, was built and tested. The prototype ballast was powered by a 120 volt ac source and used for driving two 32 watt linear fluorescent lamps. The ballast operated with a power factor of 0.997 and a total harmonic distortion of 5.5%, which is the same high degree of power factor correction provided by more costly ballasts using conventional PWM/PFC boost converter control circuits.

From the foregoing, it can be seen that power supply 10 incorporates a boost converter control circuit 200 that provides reliable switching of the boost FET 110, a high degree of power factor correction, current mode control, load regulation, and overvoltage protection, but involves significantly fewer components, and thus a lower material and manufacturing cost, than existing approaches.

Although the present invention has been described with reference to certain preferred embodiments, numerous modifications and variations can be made by those skilled in the art without departing from the novel spirit and scope of this invention.

What is claimed is:

1. An electronic power supply circuit, comprising:

a boost converter having a pair of input terminals and a pair of output terminals, the input terminals being adapted to receive a source of electrical power, the boost converter being operable to provide a substantially dc output voltage between the boost converter output terminals;

an inverter that is coupled across the boost converter output terminals, the inverter including:

a plurality of output connections adapted to be coupled to a load;

a first inverter node having a periodically varying voltage; and a second inverter node having a voltage with a peak value that is substantially proportional to the dc output voltage of the boost converter;

the boost converter comprising:

a boost inductor that is coupled between a first node and a first input terminal of the boost converter;

a boost field-effect transistor (FET) having a drain terminal, a source terminal, and a gate terminal, the drain terminal being coupled to the first node;

a boost rectifier that is coupled between the first node and a first output terminal of the boost converter;

a bulk capacitance comprising at least one capacitor that is coupled across the boost converter output terminals;

a circuit ground node that is coupled to a second input terminal and a second output terminal of the boost converter; and a control circuit for driving the boost FET, the control circuit including:

a current sense input that is coupled to the source terminal of the boost FET, a drive output that is coupled to the gate terminal of the boost FET, a drive source input that is coupled to the first inverter node, and a load regulation input that is coupled to the second inverter node;

a shunt circuit that is coupled to the drive output and the current sense input, the shunt circuit having a voltage sense input and being operable to periodically switch the boost FET off;

a low-impedance drive source network that is coupled between the drive source input and the drive output, the drive source network being operable to supply to the drive output a voltage that periodically assumes a predetermined dc level; and a load regulation network that is coupled between the load regulation input and the voltage sense input of the shunt circuit, the load regulation network being operable to supply to the voltage sense input a voltage that is substantially proportional to the boost converter dc output voltage.

2. The power supply circuit of claim 1, wherein the shunt circuit comprises:

a shunt switch having a collector lead, an emitter lead, and a base lead, wherein the collector lead is coupled to the drive output, and the base lead is coupled to the voltage sense input;

a current sense resistor that is coupled between the current sense input and the emitter lead;

a base resistor that is coupled between the current sense input and an anode of a base rectifier, the base rectifier having a cathode that is coupled to the base lead of the shunt switch;

a base capacitor that is coupled between the base lead and the circuit ground node;

an emitter biasing resistor that is coupled between the emitter lead and the circuit ground node; and an emitter clamping diode having an anode terminal that is coupled to the emitter lead, and a cathode terminal that is coupled to the circuit ground node.

3. The power supply circuit of claim 1, wherein the low-impedance drive source network comprises:

a coupling capacitor that is coupled between the drive source input and a second node;

a zener diode having a cathode that is coupled to the second node, and an anode that is coupled to the circuit ground node; and a first current-limiting resistor that is coupled between the second node and the drive output.

4. The power supply circuit of claim 1, wherein the load regulation network comprises:

a first rectifier having an anode that is coupled to the load regulation input, and a cathode that is coupled to a third node;

a dc filtering capacitor that is coupled between the third node and the circuit ground node;

a second current limiting resistor that is coupled between the third node and a fourth node; and a second rectifier having an anode that is coupled to the fourth node, and a cathode that is coupled to the voltage sense input of the shunt circuit.

5. The power supply circuit of claim 1, wherein the inverter includes two power switches, and the inverter is operable to complementarily commutate the two power switches.

6. The power supply circuit of claim 5, wherein the inverter is a resonant push-pull type inverter, comprising:

a current feed inductor having a primary winding that is coupled between the first output terminal of the boost converter and a fifth node, and a secondary winding that is coupled between the circuit ground node and the load regulation input of the boost converter control circuit;

a resonant inductor that is coupled between a sixth node and a seventh node, the resonant inductor including a center tap that is coupled to the fifth node;

a resonant capacitor that is coupled between the sixth node and the seventh node;

a first power switch that is coupled between the sixth node and the circuit ground node; and a second power switch that is coupled between the seventh node and the circuit ground node.

7. The power supply circuit of claim 6, wherein the sixth node is coupled to the drive source input of the boost converter control circuit.

8. The power supply circuit of claim 6, wherein the seventh node is coupled to the drive source input of the boost converter control circuit.

9. The power supply circuit of claim 1, wherein the boost converter input terminals are adapted to receive a source of direct current.

10. The power supply circuit of claim 1, further comprising a rectifier circuit having a pair of input wires and a pair of output wires, wherein the rectifier circuit output wires are coupled to the boost converter input terminals, and the rectifier circuit input wires are adapted to receive a source of alternating current.

11. The power supply circuit of claim 10, wherein the rectifier circuit comprises a full-wave diode bridge and a high frequency filter capacitance, the filter capacitance comprising at least one capacitor that is coupled across the rectifier circuit output wires.

12. The power supply circuit of claim 1, wherein the load comprises at least one fluorescent lamp.

13. An electronic power supply circuit, comprising:

a rectifier circuit having a pair of input wires and a pair of output wires, the rectifier circuit input wires being adapted to receive a source of alternating current;

a boost converter having a pair of input terminals and a pair of output terminals, the boost converter input terminals being coupled to the rectifier circuit output terminals, the boost converter being operable to provide a substantially dc output voltage between the boost converter output terminals;

an inverter that is coupled across the boost converter output terminals, the inverter including:

a plurality of output connections adapted to be coupled to a load;

a first inverter node having a periodically varying voltage; and a second inverter node having a voltage with a peak value that is substantially proportional to the dc output voltage of the boost converter;

the boost converter comprising:

a boost inductor that is coupled between a first node and a first input terminal of the boost converter;

a boost field-effect transistor (FET) having a drain terminal, a source terminal, and a gate terminal, the drain terminal being coupled to the first node;

a boost rectifier that is coupled between the first node and a first output terminal of the boost converter;

a bulk capacitance comprising at least one capacitor that is coupled across the boost converter output terminals;

a circuit ground node that is coupled to a second input terminal and a second output terminal of the boost converter; and a control circuit for driving the boost FET, the control circuit including:

a current sense input that is coupled to the source terminal of the boost FET, a drive output that is coupled to the gate terminal of the boost FET, a drive source input that is coupled to the first inverter node, and a load regulation input that is coupled to the second inverter node;

a shunt circuit that is coupled to the drive output and the current sense input, the shunt circuit having a voltage sense input and being operable to periodically to switch the boost FET off, the shunt circuit comprising:

a shunt switch having a collector lead, an emitter lead, and a base lead, wherein the collector lead is coupled to the drive output, and the base lead is coupled to the voltage sense input;

a current sense resistor that is coupled between the current sense input and the emitter lead;

a base resistor that is coupled between the current sense input and an anode of a base rectifier, the base rectifier having a cathode that is coupled to the base lead of the shunt switch;

a base capacitor that is coupled between the base lead and the circuit ground node;

an emitter biasing resistor that is coupled between the emitter lead and the circuit ground node; and an emitter clamping diode having an anode terminal that is coupled to the emitter lead, and a cathode terminal that is coupled to the circuit ground node;

a low-impedance drive source network that is coupled between the drive source input and the drive output, the drive source network being operable to supply at the drive output a voltage that periodically assumes a predetermined dc level; and a load regulation network that is coupled between the load regulation input and the voltage sense input of the shunt circuit, the load regulation network being operable to supply to the voltage sense input a voltage that is substantially proportional to the boost converter dc output voltage.

14. The power supply circuit of claim 13, wherein the low-impedance drive source network comprises:

a coupling capacitor that is coupled between the drive source input and a second node;

a zener diode having a cathode that is coupled to the second node, and an anode that is coupled to the circuit ground node; and a first current-limiting resistor that is coupled between the second node and the drive output;

and the load regulation network comprises:

a first rectifier having an anode that is coupled to the load regulation input, and a cathode that is coupled to a third node;

a dc filtering capacitor that is coupled between the third node and the circuit ground node;

a second current limiting resistor that is coupled between the third node and a fourth node; and a second rectifier having an anode that is coupled to the fourth node, and a cathode that is coupled to the voltage sense input of the shunt circuit.

15. The power supply circuit of claim 13, wherein the inverter is a resonant push-pull type inverter, comprising:

a current feed inductor having a primary winding that is coupled between the first output terminal of the boost converter and a fifth node, and a secondary winding that is coupled between the circuit ground node and the load regulation input of the boost converter control circuit;

a resonant inductor that is coupled between a sixth node and a seventh node, the resonant inductor including a center tap that is coupled to the fifth node;

a resonant capacitor that is coupled between the sixth node and the seventh node;

a first power switch that is coupled between the sixth node and the circuit ground node; and a second power switch that is coupled between the seventh node and the circuit ground node.

16. The power supply circuit of claim 15, wherein the sixth node is coupled to the drive source input of the boost converter control circuit.

17. The power supply circuit of claim 15, wherein the seventh node is coupled to the drive source input of the boost converter control circuit.

18. The power supply circuit of claim 13, wherein the load comprises at least one fluorescent lamp.

19. An electronic ballast for powering at least one fluorescent lamp, the ballast comprising:

a rectifier circuit having a pair of input wires and a pair of output wires, the rectifier circuit input wires being adapted to receive a source of alternating current, the rectifier circuit comprising a full-wave diode bridge and a high frequency filter capacitance, the filter capacitance comprising at least one capacitor that is coupled across the rectifier circuit output wires;

a boost converter having a pair of input terminals and a pair of output terminals, the boost converter input terminals being coupled to the rectifier circuit output terminals, the boost converter being operable to provide a substantially dc output voltage between the boost converter output terminals;

a resonant push-pull type inverter that is coupled across the boost converter output terminals, the inverter including:

a plurality of output connections adapted to be coupled to at least one fluorescent lamp;

a first inverter node having a periodically varying voltage; and a second inverter node having a voltage with a peak value that is substantially proportional to the dc output voltage of the boost converter;

the boost converter comprising:

a boost inductor that is coupled between a first node and a first input terminal of the boost converter;

a boost field-effect transistor (FET) having a drain terminal, a source terminal, and a gate terminal, the drain terminal being coupled to the first node;

a boost rectifier that is coupled between the first node and a first output terminal of the boost converter;

a bulk capacitance comprising at least one capacitor that is coupled across the boost converter output a circuit ground node that is coupled to a second input terminal and a second output terminal of the boost converter; and a control circuit for driving the boost FET, the control circuit including:

a current sense input that is coupled to the source terminal of the boost FET, a drive output that is coupled to the gate terminal of the boost FET, a drive source input that is coupled to the first inverter node, and a load regulation input that is coupled to the second inverter node;

a shunt circuit that is coupled to the drive output and the current sense input, the shunt circuit having a voltage sense input and being operable to periodically turn the boost FET off, the shunt circuit comprising:

a shunt switch having a collector lead, an emitter lead, and a base lead, wherein the collector lead is coupled to the drive output, and the base lead is coupled to the voltage sense input;

a current sense resistor that is coupled between the current sense input and the emitter lead;

a base resistor that is coupled between the current sense input and an anode of a base rectifier, the base rectifier having a cathode that is coupled to the base lead of the shunt switch;

a base capacitor that is coupled between the base lead and the circuit ground node;

an emitter biasing resistor that is coupled between the emitter lead and the circuit ground node; and an emitter clamping diode having an anode terminal that is coupled to the emitter lead, and a cathode terminal that is coupled to the circuit ground node;

a low-impedance drive source network that is coupled between the drive source input and the drive output, the drive source network being operable to supply at the drive output a voltage that periodically assumes a predetermined dc level, the drive source network comprising:

a coupling capacitor that is coupled between the drive source input and a second node;

a zener diode having a cathode that is coupled to the second node, and an anode that is coupled to the circuit ground node; and a first current-limiting resistor that is coupled between the second node and the drive output; and a load regulation network that is coupled between the load regulation input and the voltage sense input of the shunt circuit, the load regulation network being operable to supply to the voltage sense input a voltage that is substantially proportional to the boost converter dc output voltage, the load regulation network comprising:

a first rectifier having an anode that is coupled to the load regulation input, and a cathode that is coupled to a third node;

a rectifying capacitor that is coupled between the third node and the circuit ground node;

a second current limiting resistor that is coupled between the third node and a fourth node; and a second rectifier having an anode that is coupled to the fourth node, and a cathode that is coupled to the voltage sense input of the shunt circuit; and the inverter comprising:

a current feed inductor having a primary winding that is coupled between the first output terminal of the boost converter and a fifth node, and a secondary winding that is coupled between the circuit ground node and the load regulation input of the boost converter control circuit;

a resonant inductor that is coupled between a sixth node and a seventh node, the resonant inductor including a center tap that is coupled to the fifth node, the sixth node being coupled to the drive source input of the boost converter control circuit;

a resonant capacitor that is coupled between the sixth node and the seventh node;

a first power switch that is coupled between the sixth node and the circuit ground node; and a second power switch that is coupled between the seventh node and the circuit ground node.

* * * * *

UNITED STATES PATENT AND TRADEMARK OFFICE

CERTIFICATE OF CORRECTION

PATENT NO. : 5,729,098

DATED : March 17, 1998

INVENTOR(S) : Konopka, John G. et al.

It is certified that error appears in the above-indentified patent and that said Letters Patent is hereby corrected as shown below:

Column 12, line 7 reads "the boost converter output" should be -- the boost converter output terminals;--.

Signed and Sealed this

Twenty-first Day of July, 1998

Bruce Lehman

*Attest:*

BRUCE LEHMAN

*Attesting Officer*

*Commissioner of Patents and Trademarks*